US011466530B2

(12) United States Patent
Wardley et al.

(10) Patent No.: US 11,466,530 B2
(45) Date of Patent: Oct. 11, 2022

(54) OR RELATING TO WELL ABANDONMENT AND SLOT RECOVERY

(71) Applicant: ARDYNE HOLDINGS LIMITED, Aberdeen (GB)

(72) Inventors: Michael Wardley, Aberdeen (GB); Steffen Hansen, Aberdeen (GB); James Linklater, Aberdeen (GB)

(73) Assignee: ARDYNE HOLDING LIMITED, Aberdeen (GB)

( * ) Notice: Subject to any disclaimer, the term of this patent is extended or adjusted under 35 U.S.C. 154(b) by 227 days.

(21) Appl. No.: 16/609,387

(22) PCT Filed: May 3, 2018

(86) PCT No.: PCT/GB2018/051182
§ 371 (c)(1),
(2) Date: Oct. 29, 2019

(87) PCT Pub. No.: WO2018/203064
PCT Pub. Date: Nov. 8, 2018

(65) Prior Publication Data

US 2020/0088003 A1 Mar. 19, 2020

(30) Foreign Application Priority Data

May 4, 2017 (GB) ..... 1707134.1

(51) Int. Cl.
*E21B 31/00* (2006.01)
*E21B 23/01* (2006.01)
(Continued)

(52) U.S. Cl.
CPC ..... *E21B 31/005* (2013.01); *E21B 23/01* (2013.01); *E21B 23/04* (2013.01); *E21B 31/20* (2013.01)

(58) Field of Classification Search
CPC ..... E21B 31/20; E21B 31/005; E21B 23/01; E21B 23/04
See application file for complete search history.

(56) References Cited

U.S. PATENT DOCUMENTS 2,972,380 A 2/1961 Bodine
4,045,768 A 8/1977 Klimek
(Continued)

FOREIGN PATENT DOCUMENTS

WO 2011061506 A3 1/2012
WO 2015105427 A3 9/2015
(Continued)

OTHER PUBLICATIONS

International Search Report dated Jul. 31, 2018 for PCT/GB2018/051182.
(Continued)

*Primary Examiner* — Cathleen R Hutchins
*Assistant Examiner* — Ronald R Runyan
(74) *Attorney, Agent, or Firm* — Law Office of Jesse D. Lambert, LLC

(57) ABSTRACT

A method and apparatus for casing recovery for well abandonment. A string is run-in, the string including a hydraulic jack (18), an anchor (28), a casing spear (20), a downhole flow pulsing device (22) and a pressure drop sub (24). The casing spear grips an upper end of the length of casing to be pulled. The anchor is set in casing of a greater diameter above the length of cut casing. Fluid pumped through the string and through the pressure drop sub will increase fluid pressure at the hydraulic jack to a first fluid pressure (78). Fluid pumped through the downhole flow pulsing device will vary the fluid flow superimposing a cyclic pressure (82) on the first pressure (78), causing oscillation of an inner mandrel (30) of the hydraulic jack. The jack moves the
(Continued)

oscillating inner mandrel upwards relative to the anchor to pull the length of casing.

19 Claims, 4 Drawing Sheets

(51) Int. Cl.
*E21B 23/04* (2006.01)
*E21B 31/20* (2006.01)

(56) References Cited

U.S. PATENT DOCUMENTS

| | | | | |
|---|---|---|---|---|
| 4,399,783 | A * | 8/1983 | Hauser, Jr. | F16J 10/04 123/193.2 |
| 5,101,895 | A | 4/1992 | Gilbert | |
| 5,253,710 | A | 10/1993 | Carter et al. | |
| 6,279,670 | B1 | 8/2001 | Eddison et al. | |
| 6,629,565 | B2 | 10/2003 | Harrell | |
| 7,077,205 | B2 | 7/2006 | Eddison | |
| 8,167,051 | B2 | 5/2012 | Eddison et al. | |
| 8,365,826 | B2 | 2/2013 | Braddick | |
| 9,045,958 | B2 | 6/2015 | Eddison | |
| 9,598,923 | B2 | 3/2017 | Gilleylen et al. | |
| 10,030,457 | B2 * | 7/2018 | Rooyakkers | E21B 23/00 |
| 10,309,179 | B2 * | 6/2019 | Glaser | E21B 23/04 |
| 2002/0060076 | A1 | 5/2002 | Harrell | |
| 2010/0276204 | A1 | 11/2010 | Connell et al. | |
| 2012/0091732 | A1 | 4/2012 | Fallet et al. | |
| 2012/0312549 | A1 | 12/2012 | Eddison | |
| 2015/0047845 | A1 | 2/2015 | Larsen et al. | |
| 2015/0275605 | A1 | 10/2015 | Bennett et al. | |
| 2018/0258734 | A1 * | 9/2018 | Schultz, Jr | E21B 29/005 |

FOREIGN PATENT DOCUMENTS

| | | | |
|---|---|---|---|
| WO | 2017015144 | A1 | 1/2017 |
| WO | 2017043977 | A1 | 3/2017 |

OTHER PUBLICATIONS

U.S. Appl. No. 16/609,387, filed Oct. 29, 2019, Michael Wardley.
International Preliminary Report on Patentability for PCT/GB2018/051185.
TIW Casing Pulling Tool Brochure; www.tiwoiltools.com; 2015.
UK Search and Examination Report dated May 30, 2017 for GB1707134.1.
Freg et. al.; "Novel Approach to More Effective Plug and Abandonment Cementing Techniques"; Society of Petroleum Engineers; SPE Artic and Extreme Environments Conference & Exhibition; Moscow, Russia; Oct. 18-20, 2011.
International Search on Patentability dated Nov. 5, 2019 for PCT/GB2018/051180.
Schlumberger; Oilfield Review; vol. 24, No. 1; pp. 923-1730; Spring 2012; www.slb.com/oilfieldreview.
UK Search and Examination Report dated May 30, 2017 for GB17071317.

* cited by examiner

OR RELATING TO WELL ABANDONMENT AND SLOT RECOVERY

The present invention relates to apparatus and methods for well abandonment and slot recovery and in particular, though not exclusively, to an apparatus and method for casing recovery.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. This provides a need to provide tools which can pull long lengths of cut casing from the well to reduce the number of trips required to achieve casing recovery. However, the presence of drilling fluid sediments, partial cement, sand or other settled solids in the annulus between the outside of the casing and the inside of a surrounding downhole body e.g. outer casing or formation can act as a binding material limiting the ability to free the casing when pulled. Stuck casings are now a major issue in the industry.

Traditionally, cut casing is pulled by anchoring a casing spear to its upper end and using an elevator/top drive on a drilling rig. However, some drilling rigs have limited pulling capacity, and a substantial amount of power is lost to friction in the drill string between the top drive and the casing spear, leaving insufficient power at the spear to recover the casing. Consequently, further trips must be made into the well to cut the casing into shorter lengths for multi-trip recovery.

To increase the pulling capability, a downhole power tool (DHPT) available from the present Applicants, has been developed. After the casing has been located and engaged with a casing spear, hydraulically-set mechanically releasable slips anchor the DHPT to the wall of the larger ID casing above. A static pressure is applied to begin the upward movement of the cut casing, with the DHPT downhole multi-stage hydraulic actuator functioning as a hydraulic jack. After the stroke is completed, the anchors are released. The power section can be reset and the anchor re-engaged as many times as required. The DHPT is described in U.S. Pat. No. 8,365,826 to TIW Corporation, the disclosure of which is incorporated herein in its entirety by reference.

While U.S. Pat. No. 8,365,826 describes a fishing tool, there are two more traditional techniques which exist to try and free stuck casing. The first is to use an impact force on the stuck casing. This is typically applied using a hydraulic jar such as the LockJar® available from Halliburton. Unfortunately jarring can split the casing making recovery difficult. An alternative is to use vibration. The Agitator™ available from National Oilwell Varco is described in U.S. Pat. No. 6,279,670, the disclosure of which is incorporated herein in its entirety by reference. The Agitator is a downhole flow pulsing apparatus which comprises a housing for location in a drillstring, the housing defining a throughbore to permit passage of fluid through the housing. A valve is located in the bore and defines a flow passage. The valve includes a valve member which is movable to vary the area of the passage to provide a varying fluid flow therethrough. A fluid actuated positive displacement motor is associated with the valve member. In a preferred embodiment, the apparatus is provided in combination with a drill bit and a pressure responsive device, such as a shock-sub, which expands or retracts in response to the varying drilling fluid pressure created by the varying flow passage area. The expansion or retraction of the shock-sub provides a percussive effect at the drill bit.

Further, U.S. Pat. No. 7,077,205, the disclosure of which is incorporated herein in its entirety by reference, describes a method of freeing stuck objects from a bore comprising running a string into the bore, the string including a flow modifier, such as a valve, for producing variations in the flow of fluid through the string, and a device for location in the string and adapted to axially extend or contract in response to variations in the flow of fluid through the string. A portion of the string engages the stuck object. Fluid is then passed through the string while applying tension to the string, whereby the tension applied to the stuck object varies in response to the operation of the flow modifier and the extending or retracting device. Thus the Agitator may be used with a shock-sub to free a cut casing section. While this arrangement uses a percussive effect to free the casing, it is still limited by the drilling rigs pulling capability.

An object of the present invention is to provide apparatus for casing recovery which is capable of pulling long lengths of casing from a well.

It is a further object of the present invention is to provide a method for casing recovery which is capable of pulling long lengths of casing from a well.

According to a first aspect of the present invention there is provided apparatus for the recovery of a length of casing from a well, comprising a string for running into the well, the string being arranged to carry a fluid in a throughbore thereof and including:

a hydraulic jack, the hydraulic jack comprising an anchor for axially fixing the apparatus to a tubular in the well, and an inner mandrel axially moveable relative to the anchor in response to the fluid at a first pressure in the throughbore;

a casing spear connected to the inner mandrel for engaging the length of casing;

a downhole flow pulsing device for varying fluid flow in the throughbore and thereby superimpose a cyclic pressure on the first pressure;

at least one pressure drop sub to increase pressure of the fluid in the throughbore at the hydraulic jack to the first pressure;

wherein fluid at the first pressure superimposed with the cyclic pressure operates the hydraulic jack so that the inner mandrel oscillates as it moves axially and pulls the length of casing.

In this way, longer lengths of casing can be removed by creating a high vibratory pull which will dislodge the drilling fluid sediments, partial cement, sand or other settled solids in the annulus between the outside of the casing and the inside of a surrounding downhole body.

Preferably, the cyclic pressure amplitude is up to 4% of the first pressure. More preferably, the cyclic pressure amplitude is up to 25% of the first pressure. An increased vibration on the mandrel may further assist in freeing the casing if it at first appears stuck.

Preferably, the hydraulic jack includes a housing supported in the well by the string and enclosing a plurality of axially stacked pistons generating a cumulative axial force, each of the plurality of pistons axially movable in response to the fluid at the first pressure; and wherein movement of the pistons also moves the inner mandrel. In this way, a great pulling force can be created downhole at the jack. Preferably the hydraulic jack is the DHPT supplied by Ardyne AS.

Preferably, the downhole flow pulsing device comprises a housing located in the string, a valve located in the throughbore defining a flow passage and including a valve member, the valve member being movable to vary the area of the flow passage to, in use, provide a varying fluid flow therethrough; and a fluid actuated positive displacement motor operatively associated with the valve for driving the valve member. In this way, the cyclic pressure variations on the fluid are as the fluid flows through the downhole flow pulsing device. Preferably the downhole flow pulsing device is the Agitator™ supplied by National Oilwell Varco.

Preferably the casing spear comprises: a sliding assembly mounted on the inner mandrel; at least one gripper for gripping onto an inner wall of the length of casing, the gripper being coupled to the sliding assembly; the sliding assembly being operable for moving the gripper between a first position in which the gripper is arranged to grip onto the inner wall of the length of casing in at least one gripping region of the length of casing and a second position in which the gripper is held away from the inner wall; and a switcher which, when advanced into the length of casing, locks the sliding assembly to the inner mandrel with the gripper in the second position; and, when the casing spear is pulled upward out of the length of casing and the switcher exits the end of the length of casing, automatically allows engagement of the length of casing by the gripper in the first position. In this way, the length of casing is automatically gripped into engagement with the casing spear when the casing spear is at the top of the length of casing. Preferably the casing spear is the FRM Spear supplied by Ardyne AS.

Preferably, the pressure drop sub comprises a housing located in the string and one or more apertures through a wall of the housing to provide at least one fluid flow path from the throughbore to an outer surface of the housing. Preferably the apertures are nozzles. In this way, the cross-sectional area of the nozzles is significantly less than the cross-sectional area of the throughbore so that a build-up of fluid pressure occurs when fluid is pumped down the string. This is used to create the first pressure for operating the hydraulic jack.

Preferably the casing spear is located between the hydraulic jack and the downhole flow pulse device. Preferably the downhole flow pulse device is located between the casing spear and a pressure drop sub. There may be a pressure drop sub located between the casing spear and the downhole flow pulse device. Alternatively, the downhole flow pulse device may be located between two pressure drop subs. In this way, the downhole flow pulse device and the pressure drop subs are located in the length of casing and the hydraulic jack is anchored to tubular, preferably casing, having a greater diameter than the length of casing being pulled.

Preferably, in the hydraulic jack the plurality of axially stacked pistons include a plurality of inner pistons each secured to the inner mandrel and a plurality of outer pistons each secured to a tool housing supported by the string. Preferably, the axial force generated by the plurality of pistons acts simultaneously on the anchor and on the tool mandrel, such that the tool anchoring force increases when the axial force on the tool mandrel increases. Preferably, the anchor includes a plurality of slips circumferentially spaced about the mandrel for secured engagement with an interior wall in the well. Preferably, an axial force applied to the plurality of slips is reactive to the force exerted on the casing spear by the plurality of pistons. Preferably, the jack includes a right-hand threaded coupling interconnected to the inner mandrel for selectively releasing an upper portion of the tool from a lower portion of the tool.

Preferably, in the downhole flow pulsing device the speed of the motor is directly proportional to the rate of flow of fluid through the motor. Preferably, the positive displacement drive motor includes a rotor and the rotor is linked to the valve member. Preferably, the rotor is utilised to rotate the valve member. Preferably, the rotor is linked to the valve member via a universal joint which accommodates transverse movement of the rotor. Alternatively, the rotor may be linked to the valve member to communicate transverse movement of the rotor to the valve member. Preferably, the valve member cooperates with a second valve member, each valve member defining a flow port, the alignment of the flow ports varying with the transverse movement of the first valve member. Preferably, the positive displacement motor operates using the Moineau principle and includes a lobed rotor which rotates within a lobed stator, the stator having one more lobe than the rotor. Preferably, the motor is a 1:2 Moineau motor.

According to a second aspect of the present invention there is provided a method for the recovery of a length of casing from a well, comprising the steps:

(a) running apparatus on a string into the well, the string being arranged to carry a fluid in a throughbore thereof and the apparatus including a hydraulic jack, a casing spear, a downhole flow pulsing device and a pressure drop sub;
(b) locating the casing spear in an end of the length of casing and gripping the length of casing;
(c) setting an anchor of the hydraulic jack on tubing at a shallower depth in the well than the length of casing;
(d) flowing fluid through the string and through the pressure drop sub to thereby increase fluid pressure at the hydraulic jack to a first fluid pressure;
(e) varying fluid flow via the downhole flow pulsing device;
(f) superimposing a cyclic pressure on the first pressure;
(g) inputting fluid at the first pressure superimposed with the cyclic pressure to the hydraulic jack; and
(h) causing oscillation of an inner mandrel of the hydraulic jack;
(i) axially moving the oscillating inner mandrel relative to the anchor to pull the length of casing.

In this way, oscillations of the inner mandrel are transmitted to the length of casing via the casing spear which helps dislodge the drilling fluid sediments, partial cement, sand or other settled solids in the annulus between the outside of the casing and the inside of a surrounding downhole body. A longer length of casing is thus more easily removed from the well with a lower risk of being stuck.

Preferably, the cyclic pressure amplitude is up to 4% of the first pressure. More preferably, the cyclic pressure amplitude is up to 25% of the first pressure. An increased vibration on the mandrel may further assist in freeing the casing if it at first appears stuck.

Preferably, the apparatus is according to the first aspect.

Preferably, an axial force generated by a plurality of pistons in the hydraulic jack acts simultaneously on the anchor and on the inner mandrel, such that the apparatus anchoring force increases when the axial force on the inner mandrel increases.

Preferably, the anchor is set in response to axial movement of the plurality of pistons.

Preferably, step (e) includes driving a valve member in the downhole puling device and varying the cross-sectional area of the throughbore.

Preferably the method includes the final step of pulling the string via a top drive or elevator to surface.

The method may include the further steps, before the final step, of:

(j) stroking the hydraulic jack to pull the length of casing;

(k) releasing the anchor;

(l) pulling the string so as to raise an outer housing of the hydraulic jack and the anchor;

(m) resetting the anchor and repeating steps (d) to (i).

Steps (j) to (m) can be repeated until the final step is achievable. In this way, the apparatus and method of the present invention have assisted casing recovery via a top drive/elevator.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

FIGS. 1(*a*) to 1(*f*) illustrate apparatus and method for recovery of a length of casing in a well, according to an embodiment of the present invention;

Figures 1A, 1B, 1C, 1D, 1E, 1F:
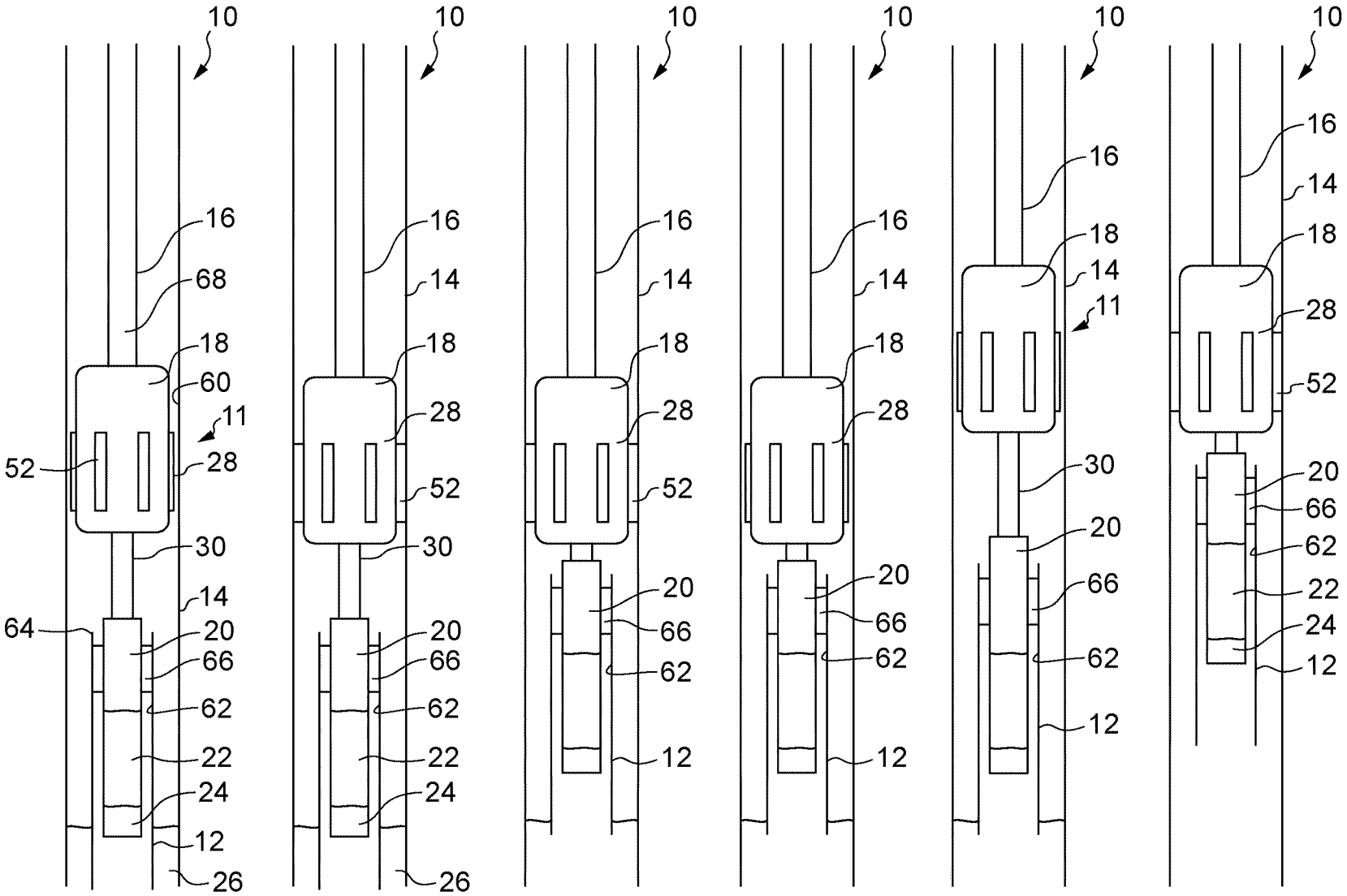

Reference is initially made to FIG. 1 of the drawings which illustrates a method of recovering casing from a well, according to an embodiment of the present invention. In FIG. 1(*a*) there is shown a cased well bore, generally indicated by reference numeral 10, in which a length of casing 12 requires to be recovered. A tool string 16 including apparatus 11 is run in the well 10. Apparatus 11 includes a hydraulic jack 18, a casing spear 20, a downhole flow pulsing device 22, and a pressure drop sub 24.

The casing spear 20, downhole flow pulsing device 22, and pressure drop sub 24 may be formed integrally on a single tool body or may be constructed separately and joined together by box and pin sections as is known in the art. Two or more parts may also be integrally formed and joined to any other part.

The tool string 16 is a drill string typically run from a rig (not shown) via a top drive/elevator system which can raise and lower the string 16 in the well 10. The well 10 has a second casing 14. Casing 14 has a greater diameter than casing 12. In an embodiment, length of casing 12 is 9⅝" diameter while the outer casing is 13⅜" diameter.

Casing 12 will have been cut to separate it from the remaining casing string. The cut casing may be over 100 m in length. It may also be over 200 m or up to 300 m. Behind the casing 12 there may be drilling fluid sediments, partial cement, sand or other settled solids in the annulus between the outside of the casing 12 and the inside of a surrounding downhole body, in this case casing 14 but it may be the formation of the well 10. This material 26 can prevent the casing 12 from being free to be pulled from the well 10. It is assumed that this is the position for use of the present invention.

The hydraulic jack 18 has an anchor 28 and an actuator system which pulls an inner mandrel 30 up into a housing 32 of the jack 18. In a preferred embodiment the hydraulic jack is the DHPT available from Ardyne AS. It is described in U.S. Pat. No. 8,365,826 to TIW Corporation, the disclosure of which is incorporated herein in its entirety by reference.

Figure 2A:
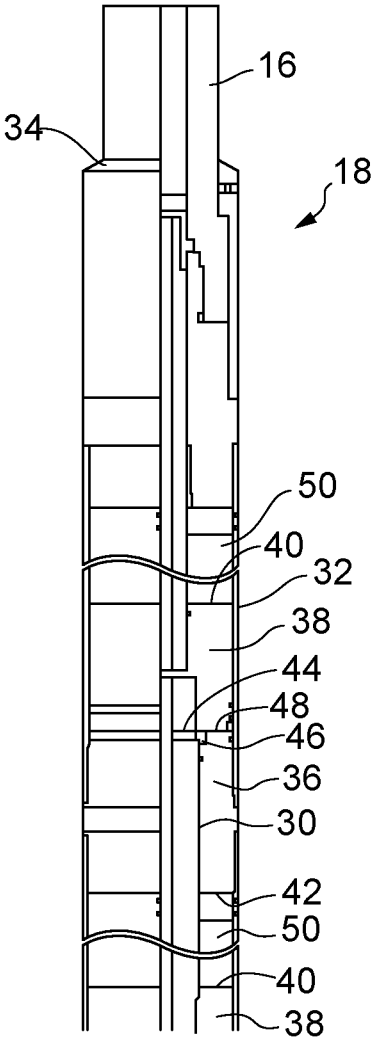
FIG. 2(*a*) is a part sectional view of an actuator section of a hydraulic jack and FIG. 2(*b*) is a part sectional view of an anchor of the hydraulic jack, according to an embodiment of the present invention.
Figure 2B:
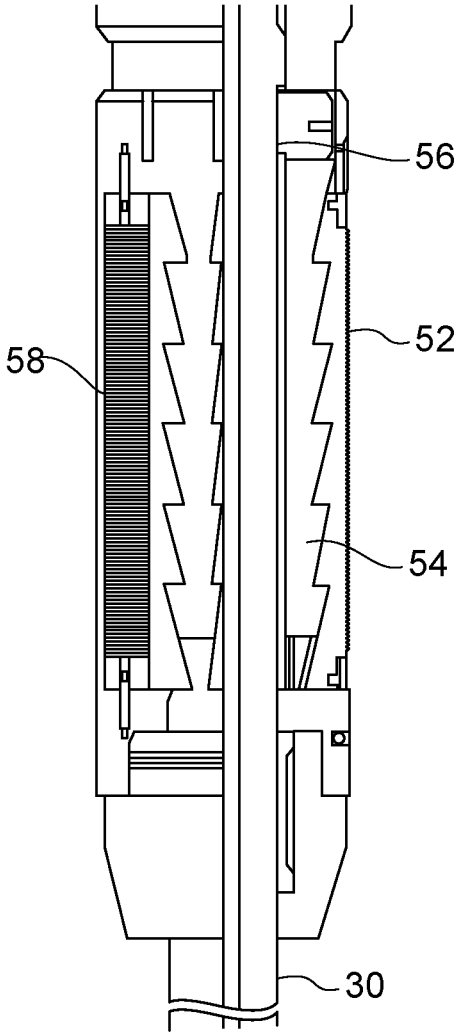

Referring to FIGS. 2(*a*) and 2(*b*) there is illustrated the main features of the hydraulic jack 18. FIG. 2(*a*) shows a portion of the actuator system. The jack 18 has an outer housing 32 with a connection 34 to the tool string 16. There is an inner mandrel 30 which can move axially within the housing 32. A series of spaced apart outer pistons 36 are connected into the housing 32. A series of spaced apart inner pistons 38 are connected to the inner mandrel 30. The pistons 36,38 are stacked between each other so that an upper end face 40 of an inner piston 38 will abut a lower end face 42 of an outer piston 36. Only one set of pistons 36,38 are shown but this arrangement is repeated along the mandrel 30 to provide five sets of pistons 36,38. The inner mandrel 30 includes a number of ports 44 arranged circumferentially around the mandrel 30, at the upper end of each outer piston 36, when the inner piston 38 rests on the outer piston 36. A chamber 46 is provided at this location so that fluid can enter the ports 44 and will act on the lower end face 48 of the inner piston 38. This will move the piston 38 upwards, crossing a vented space 50, until the upper end face 40 of the inner piston 38 abuts the lower end face 42 of the outer piston 36. This movement constitutes a stroke of the jack 18. Movement of the inner mandrel 30 is driven by movement of the inner pistons 38. As there are multiple stacked pistons 38, the combined cross-sectional areas of the end faces 40 when fluid pressure is applied generates a considerable lifting force via the inner mandrel 30.

Hydraulic jack 18 also includes an anchor 28, shown in FIG. 2(*b*). Anchor 28 has a number of slips 52 arranged to ride up a cone 54 by the action of fluid entering a chamber 56 and moving the cone 54 under the slips 52. The outer surface 58 of the slips 52 is toothed to grip an inner surface 60 of the casing 14. The anchor 28 is connected to the outer housing 32 so that the inner mandrel 30 can move axially relative to the anchor 28 when the anchor is set to grip the casing 14.

Casing spear 20 operates by a similar principle to grip the inner surface 62 of the length of casing 12. The casing spear anchors as a slip designed to ride up a wedge and by virtue of wickers or teeth on its outer surface grip and anchor to the inner surface 62 of the casing 12. The casing spear 20 includes a switch which allows the casing spear to be inserted into the casing 12 and hold the slips in a disengaged position until such time as the grip is required. At this time, the casing spear 20 is withdrawn from the end 64 of the casing 12 and, as the switch exits the casing 12, it automatically operates the slips which are still within the casing 12 at the upper end 64 thereof. This provides the ideal setting position of the spear 20. In a preferred embodiment the casing spear 20 is the Flow Release Mechanism (FRM) Spear as provided by the Ardyne AS. The FRM Spear is described in PCT/EP2017/059345, the disclosure of which is incorporated herein in its entirety by reference.

The downhole flow pulsing device 22 is a circulation sub which creates fluid pulses in the flow passing through the device. This can be achieved by a rotating member or a rotating valve. In a preferred embodiment the downhole flow pulsing device 22 is the Agitator™ System available from National Oilwell Varco. It is described in U.S. Pat. No. 6,279,670, the disclosure of which is incorporated herein in its entirety by reference. For completeness we provide FIGS. 3(*a*) and 3(*b*) from the patent together with the accompanying description. Only reference numerals have been changed to distinguish from features in earlier figures.

Figure 3A:
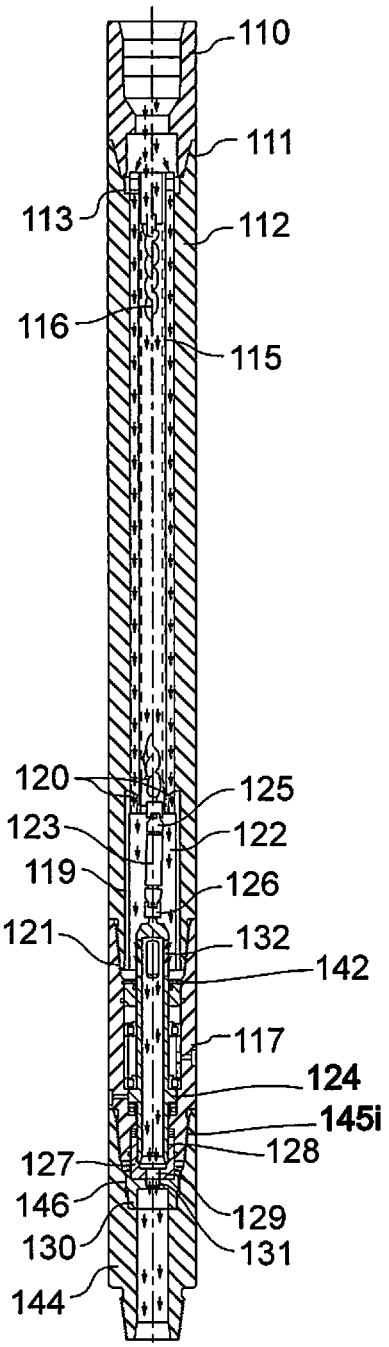
FIG. 3(*a*) is a sectional view through a downhole flow pulsing device and FIG. 3(*b*) is the lower portion in an expanded view, according to an embodiment of the present invention.
Figure 3B:
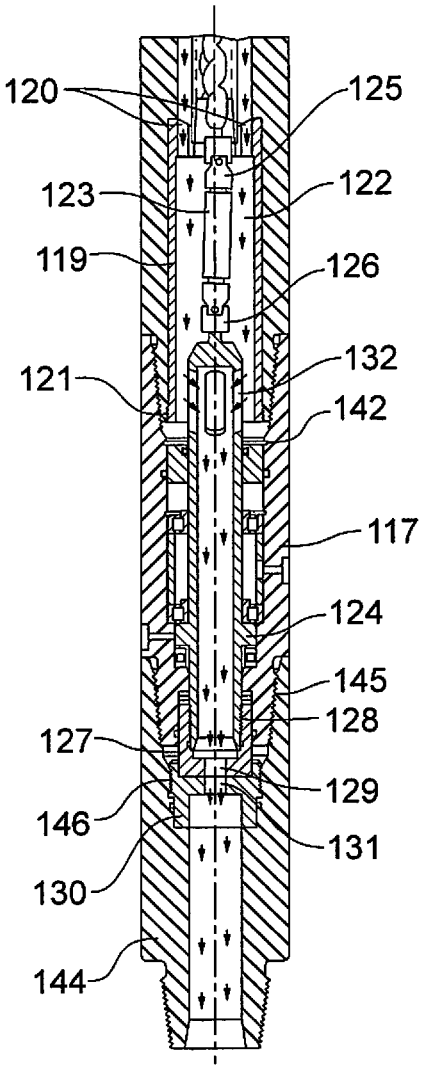

Reference is now made to FIGS. 3(*a*) and 3(*b*) of the drawings. The sub comprises a top section 110 connected by a threaded joint 111 to a tubular main body 112. A flow insert 113 is keyed into the main body 112 and flow nozzles 114 are screwed into the flow insert 113. The keyed flow insert 113 is attached to a motor stator 115 which contains a freely revolving rotor 116. The motor is of the positive displacement type, operating using the Moineau principle. The top section 110, keyed flow insert 113, flow nozzles 114, motor stator 115 and the main body 112 all allow drilling fluid to pass through the sub; in use, high velocity drilling fluid enters the top section 110. The flow is then channelled through the flow insert 113 and the flow nozzles 114. A balanced flow rate is achieved between the flow insert 113 and the flow nozzles 114 allowing the drilling fluid to rotate the rotor 116 at a defined speed in relation to the drilling fluid flow rate.

The lower end of the motor stator 115 is supported within a tubular insert 119 which has a threaded connection at its lower end 121 and has fluid passageways 120 to allow fluid to flow from the flow nozzles 114 over the motor stator 115 and into a chamber 122 defined by the insert 119.

The rotor 116 is connected at its lower end to a shaft 123 which in turn is connected to a tubular centre shaft 124. The shaft 124 extends into an intermediate outer body 117 connected to the main body 112 by way of a threaded connection. The connecting shaft 123 is located at either end by a universal joint 125 and 126. The rotor torque is thus directly translated through the connecting shaft 123 and universal joints 125 and 126 to the centre shaft 124.

A first valve plate 127 is attached to the lower end of the centre shaft 124 via a threaded connection 128. The valve plate 127 defines a slot opening 129 which provides a fluid passageway for drilling fluid to flow onto the fixed second valve plate 130 which also defines a slot 131; the slots 129, 131 thus define an open axial flow passage. The fixed valve plate 130 is attached to an end body 144 by way of threaded connection 146.

Drilling fluid is channelled through radial slots 132 in the upper end of the centre shaft 124 into the centre of the shaft 124 whilst the shaft rotates. Fluid then travels through the first slot 129 and as the two slots 129 and 131 rotate into and out of alignment with each other fluid flow is restricted periodically, causing a series of pressure pulses.

The pressure drop sub 24 has a housing located in the string and apertures through a wall of the housing to provide multiple narrow fluid flow paths from the throughbore to an outer surface of the housing. Nozzles are located in the apertures. The cross-sectional area of the nozzles is significantly less than the cross-sectional area of the throughbore so that a build-up of fluid pressure occurs when fluid is pumped down the string. This is used to create the first pressure for operating the hydraulic jack. In FIG. 1, the pressure drop sub 24 is located below the downhole flow pulsing device 22. Alternatively, the pressure drop sub can be located between the casing spear 20 and the downhole flow pulsing device 22. Such an arrangement reduces the pressure through the downhole flow pulsing device 22, which itself will also cause a pressure drop. There could be a pressure drop sub on either side of the downhole flow pulsing device 22 to provide both a suitable pressure to operate the hydraulic jack i.e. the first pressure and a suitable pressure for operating the downhole flow pulsing device 22.

Referring again to FIG. 1(*a*), the string 16 is run into the well 10 with the pressure drop sub 24, downhole flow pulsing device 22 and casing spear 20 being run-in the casing 12. The string 16 is raised to a position to operate the switch on the casing spear 20 and the slips 66 automatically engage the inner surface 62 of the casing 12 at the upper end 64 thereof. At this stage the string 16 can be pulled via the top drive/elevator to see if the casing 12 is stuck.

Referring now to FIG. 1(*b*), slips 52 on the anchor 28 of the hydraulic jack 18 are operated to engage the inner surface 60 of the outer casing 14. As with the casing spear 20, an overpull on the string 16 will force the teeth on the slips into the surface 60 to provide anchoring.

Figure 4:
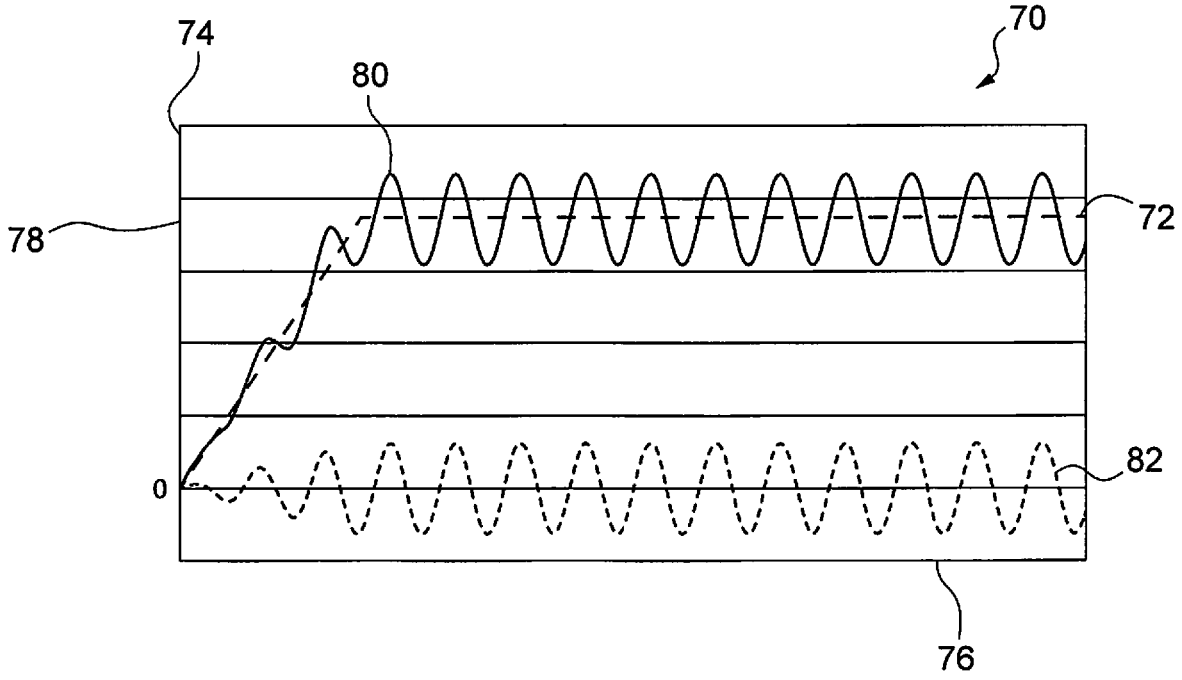
FIG. 4 is a graph illustrating applied load against time for the linearly applied first pressure, the cyclic pressure and the first pressure superimposed with the cyclic pressure.

With fluid flowing down a throughbore 68 of the string 16, the pressure of the fluid will build up by virtue of the restrictions at the nozzles of the pressure drop sub 24. This fluid pressure will linearly increase to a static first pressure/load 78. This linear increase is shown as a straight line in graph 70 but it may be a curve as long as it is smooth and increasing. This change in fluid pressure can be seen as line 72 in the graph 70 of applied load 74 against time 76 shown in FIG. 4. At the same time, the fluid flow through the downhole flow pulsing device 22 will create pressure pulses seen as a cyclic variation of pressure and consequently applied load. For the downhole flow pulsing device 22 taken in isolation, the cyclic variation is illustrated by line 82. This provides an oscillation at a frequency of less than 10 Hz. In preferred embodiments the frequency will be less than 5 Hz, 2 Hz or 1 Hz and even operate at 0.5 Hz. This low frequency is selected so as to effectively influence the vibration on the inner mandrel 30. The cyclic variation induced by the downhole flow pulsing device 22 will be superimposed on the fluid pressure in the throughbore 68. The resulting fluid pressure and equivalent applied load is illustrated as line 80 on graph 70. The amplitude of the cyclic variations can be selected to determine the axial extent of the oscillatory movement on the inner mandrel 30. In contrast to the known arrangements of causing a percussive effect by using a shock sub in which the subs entire movement is oscillatory, the oscillatory motion of the inner mandrel 30 is only a small percentage so that the pulling force of the jack 18 is not affected. The amplitude of the cyclic pressure variation is selected to be up to 4% of the value of the first pressure. In an embodiment, the amplitude of the cyclic pressure variation can be up to 25% of the value of the first pressure.

Fluid at the superimposed pressure will enter the ports 44 on the jack 18. The first fluid pressure will be sufficient to move all the inner pistons 38 so forcing the inner mandrel 30 upwards into the housing 32. As the inner mandrel 30 is connected to the casing spear 20 which is in turn anchored to the length of casing 12, the force on the length of casing will match the applied load of the first pressure 78. This force should be sufficient to release the casing 12 and allow it to move. The cyclic pressure will act on the pistons 38 and through the inner mandrel 30. The inner mandrel will therefore vibrate or axially oscillate at the frequency of the created by the downhole flow pulsing device 22. The inner mandrel is directly connected to the spear 20 and the casing 12. Such vibration has been shown to assist in releasing stuck casing and thus this action can assist during the pulling of the casing 12 by the jack 18. It is hoped that the jack 18 can make a full stroke to give maximum lift to the casing 12. This is illustrated in FIG. 1(*c*). If the casing 12 is still stuck only a partial stroke will be achieved. In either case, the anchor 28 is unset, by setting down weight, as shown in FIG. 1(*d*).

Raising the string 16 will now lift the housing 32 with respect to the inner mandrel 30, repositioning the pistons 36,38 to recreate vented space 50.

The jack is thus re-set in the operating position as illustrated in FIG. 1(*a*). This is now shown in FIG. 1(*e*) with the casing 12 now raised in the casing 14. As the string 16 is raised, the casing 12 may be free and then the entire apparatus 11 and the length of casing 12 can be recovered to surface and the job complete.

If the casing 12 remains stuck, the anchor 28 is re-engaged as illustrated in FIG. 1(*f*) and the steps repeated as described and shown with reference to FIGS. 1(*b*) to 1(*e*). The steps can be repeated any number of times until the length of casing 12 is free and can be pulled to surface by raising the string 16 using the top drive/elevator on the rig.

The principle advantage of the present invention is that it provides a method and apparatus for recovering the maximum possible length of casing in a single piece from a well.

A further advantage of the present invention is that it provides a method and apparatus for pulling stuck casing from a well.

It will be apparent to those skilled in the art that modifications may be made to the invention herein described without departing from the scope thereof. For example, the tool string may include other tools such as a cutting tool to cut the casing. Additionally, where reference has been made to shallower and deeper, together with upper and lower positions in the well bore, it will be recognised that these are relative terms and relate to a vertical well bore as illustrated but could apply to a deviated well.

We claim:

1. Apparatus for the recovery of a length of casing from a well, comprising a string for running into the well, the string being arranged to carry a fluid in a throughbore thereof and including:

a hydraulic jack, the hydraulic jack comprising an anchor for axially fixing the apparatus to a tubular in the well, and an inner mandrel axially moveable relative to the anchor in response to the fluid at a first pressure in the throughbore;

a casing spear connected to the inner mandrel for engaging the length of casing;

a downhole flow pulsing device for varying fluid flow in the throughbore and thereby superimpose a cyclic pressure on the first pressure;

the casing spear is located between the hydraulic jack and the downhole flow pulsing device;

at least one pressure drop sub to increase pressure of the fluid in the throughbore at the hydraulic jack to the first pressure;

wherein fluid at the first pressure superimposed with the cyclic pressure operates the hydraulic jack so that the inner mandrel oscillates as it moves axially and pulls the length of casing.

2. The apparatus according to claim 1 wherein the cyclic pressure amplitude is up to 4% of the first pressure.

3. The apparatus according to claim 1 wherein the cyclic pressure amplitude is up to 25% of the first pressure.

4. The apparatus according to claim 1 wherein the hydraulic jack includes a housing supported in the well by the string and enclosing a plurality of axially stacked pistons generating a cumulative axial force, each of the plurality of pistons axially movable in response to the fluid at the first pressure; and wherein movement of the pistons also moves the inner mandrel.

5. The apparatus according to claim 4 wherein the plurality of axially stacked pistons include a plurality of inner pistons each secured to the inner mandrel and a plurality of outer pistons each secured to a tool housing supported by the string.

6. The apparatus according to claim 1 wherein the downhole flow pulsing device comprises a housing located in the string, a valve located in the throughbore defining a flow passage and including a valve member, the valve member being movable to vary the area of the flow passage to, in use, provide a varying fluid flow therethrough; and a fluid actuated positive displacement motor operatively associated with the valve for driving the valve member.

7. The apparatus according to claim 1 wherein the casing spear comprises: a sliding assembly mounted on the inner mandrel; at least one gripper for gripping onto an inner wall of the length of casing, the gripper being coupled to the sliding assembly; the sliding assembly being operable for moving the gripper between a first position in which the gripper is arranged to grip onto the inner wall of the length of casing in at least one gripping region of the length of casing and a second position in which the gripper is held away from the inner wall; and a switcher which, when advanced into the length of casing, locks the sliding assembly to the inner mandrel with the gripper in the second position; and, when the casing spear is pulled upward out of the length of casing and the switcher exits the end of the length of casing, automatically allows engagement of the length of casing by the gripper in the first position.

8. The apparatus according to claim 1 wherein the pressure drop sub comprises a housing located in the string and one or more apertures through a wall of the housing to provide at least one fluid flow path from the throughbore to an outer surface of the housing.

9. The apparatus according to claim 1 wherein the downhole flow pulse device is located between the casing spear and a pressure drop sub.

10. The apparatus according to claim 1 wherein a pressure drop sub is located between the casing spear and the downhole flow pulse device.

11. The apparatus according to claim 10 wherein the downhole flow pulse device is located between two pressure drop subs.

12. The apparatus according to claim 1 wherein the anchor includes a plurality of slips circumferentially spaced about the inner mandrel for secured engagement with the tubular.

13. The apparatus according to claim 1 wherein the jack includes a right-hand threaded coupling interconnected to the inner mandrel for selectively releasing the jack from the casing spear.

14. A method for the recovery of a length of casing from a well, comprising the steps:

(a) running apparatus on a string into the well, the string being arranged to carry a fluid in a throughbore thereof and the apparatus including:

a hydraulic jack, the hydraulic jack comprising an anchor for axially fixing the apparatus to a tubular in the well, and an inner mandrel axially moveable relative to the anchor in response to the fluid at a first pressure in the throughbore;

a casing spear connected to the inner mandrel for engaging the length of casing;

a downhole flow pulsing device for varying fluid flow in the throughbore and thereby superimpose a cyclic pressure on the first pressure;

the casing spear is located between the hydraulic jack and the downhole flow pulsing device; and at least one pressure drop sub to increase pressure of the fluid in the throughbore at the hydraulic jack to the first pressure;

(b) locating the casing spear in an end of the length of casing and gripping the length of casing;

(c) setting the anchor of the hydraulic jack on tubing at a shallower depth in the well than the length of casing;

(d) flowing fluid through the string and through the pressure drop sub to thereby increase fluid pressure at the hydraulic jack to the first fluid pressure;

(e) varying fluid flow via the downhole flow pulsing device;

(f) superimposing the cyclic pressure on the first pressure;

(g) inputting fluid at the first pressure superimposed with the cyclic pressure to the hydraulic jack; and (h) causing oscillation of the inner mandrel of the hydraulic jack;

(i) axially moving the oscillating inner mandrel relative to the anchor to pull the length of casing.

15. The method according to claim 14 wherein an axial force generated by a plurality of pistons in the hydraulic jack acts simultaneously on the anchor and on the inner mandrel, such that the apparatus anchoring force increases when the axial force on the inner mandrel increases.

16. The method according to claim 15 wherein the anchor is set in response to axial movement of the plurality of pistons.

17. The method according to claim 14 wherein step (e) includes driving a valve member in the downhole flow pulsing device and varying the cross-sectional area of the throughbore.

18. The method according to claim 14 wherein the method includes the further steps of:

(j) stroking the hydraulic jack to pull the length of casing;

(k) releasing the anchor;

(l) pulling the string so as to raise an outer housing of the hydraulic jack and the anchor;

(m) resetting the anchor and repeating steps (d) to (i).

19. The method according to claim 18 wherein the method includes a final step of pulling the string via a top drive or elevator to surface and steps (j) to (m) are repeated until the final step is achievable.

* * * * *